US005390615A

United States Patent [19]

Sugimoto

[11] Patent Number: 5,390,615

[45] Date of Patent: Feb. 21, 1995

[54] EMBROIDERY MACHINE

[75] Inventor: Nami Sugimoto, Nagoya, Japan

[73] Assignee: Brother Kogyo Kabushiki Kaisha, Nagoya, Japan

[21] Appl. No.: 154,526

[22] Filed: Nov. 19, 1993

[30] Foreign Application Priority Data

Feb. 10, 1993 [JP] Japan ..... 5-022561

[51] Int. Cl.[6] ..... D05B 21/00

[52] U.S. Cl. ..... 112/121.12; 112/266.1

[58] Field of Search ..... 112/121.12, 103, 456, 112/458, 445, 121.11, 266.1, 262.3

[56] References Cited

U.S. PATENT DOCUMENTS 4,763,586 8/1988 Takenoya et al. ..... 112/103
4,823,714 4/1989 Yokoe et al. ..... 112/121.12 X
5,107,778 4/1992 Hisatake et al. ..... 112/121.12
5,228,403 7/1993 Sugimoto ..... 112/121.12
5,255,620 10/1993 Sasano ..... 112/121.12

*Primary Examiner*—Peter Nerbun
*Attorney, Agent, or Firm*—Oliff & Berridge

[57] ABSTRACT

An embroidery machine incorporates a stitch pattern selecting system capable of selecting a possible scale for a selected pattern on which the selected pattern is to be stitched to omit the repetition of pattern selection after determining a scale in order that a series of pattern selecting operations can be carried out easily and efficiently. When selecting a pattern and a scale on which the pattern is to be stitched, a CPU calculates the sizes of the selected pattern on all the scales and compares the sizes of the selected pattern with a predetermined available area for embroidering. The CPU specifies the available scales.

14 Claims, 11 Drawing Sheets

EMBROIDERY MACHINE

BACKGROUND OF THE INVENTION

1. Field of the Invention

The present invention relates to an embroidery machine and, more particularly, to an embroidery machine incorporating a stitch pattern selecting system and capable of stitching an embroidery in a desired size.

2. Description of the Related

As shown in FIG. 2, a known embroidery machine has a bed 1, a post 2 standing in the right-hand end of the bed 1, an arm 3 laterally extending from the upper end of the post 2 over the bed 1, and a sewing head 4 attached to the extremity of the arm 3. The arm 3 is provided with a needle bar driving mechanism, not shown, for vertically reciprocating a needle bar 5 holding a needle 6 on its lower end, a needle bar swinging mechanism, not shown, for swinging the needle bar 5 in a direction perpendicular to a feed direction in which a workpiece is fed, a thread take-up lever driving mechanism, not shown, for vertically swinging a thread take-up lever 5 in synchronism with the vertical reciprocation of the needle bar 5, and the associated parts. A main motor 14 drives the needle bar driving mechanism, and a stepping motor 15 drives the thread take-up lever driving mechanism.

A liquid crystal display 10 is put on the front surface of the arm 3 to display symbols representing various pattern elements and stitching functions of the embroidery machine M. Touch keys 11 serving also as transparent electrodes are arranged on the front surface of the liquid crystal display 10 at positions corresponding to the symbols. The touch key 11 corresponding to a symbol representing a desired pattern element is depressed to select the desired pattern element. The start/stop key (hereinafter, referred to as "S/S key") 12 of a start/stop switch (hereinafter, referred to as "S/S switch") for starting and stopping a stitching operation is disposed on the sewing head 4.

An embroidery unit 30 is mounted on the left-hand portion of the bed 1. The embroidery unit 30 is provided with an embroidery table 31 capable of moving along a Y-axis parallel to the feed direction in which a workpiece is fed and along an X-axis perpendicular to the Y-axis. An embroidery frame, not shown, for detachably holding a workpiece is mounted detachably on the embroidery table 31. A first stepping motor 32 for driving the embroidery table 31 to move along the X-axis and a second stepping motor 33 for driving the embroidery table 31 to move along the Y-axis are disposed within the main frame 32 of the embroidery unit 30. The stepping motors 32 and 33 and the needle bar 5 are driven according to driving signals provided by the embroidery machine M to stitch a desired stitch pattern on the workpiece held on the embroidery frame.

Referring to FIG. 3, showing the configuration of an embroidery machine, switches operated by the touch keys 11 and the S/S switch operated by the S/S key 12 are connected to a CPU 23. The main motor 14, the stepping motor 18 for driving the needle bar for swing motion, a display controller (LCDC) 20 for controlling the liquid crystal display (LCD) 10, and the first stepping motor 32 and second stepping motor 33 of the embroidery unit 30 are controlled by the CPU 23. Data including embroidery data to be displayed on the liquid crystal display 10 is stored in a ROM 24. A RAM 25 stores embroidery data temporarily.

When the embroidery machine M is connected to a power source, a pattern element selection picture as shown in FIG. 7(*a*) is displayed on the liquid crystal display 10. If necessary, a page up key 40 or a page down key 41 is operated to display a picture including desired pattern elements. A touch key corresponding to a desired pattern element displayed on the liquid crystal display 10 is depressed to select the desired pattern element. A cancel key 43 is depressed to cancel the selected pattern element. Thus, a desired stitch pattern consisting of pattern elements can be selected.

When thus selecting a desired stitch pattern, the CPU 23 determines if the desired stitch pattern can be formed within a predetermined available area. The CPU 23 selects the desired stitch pattern when the desired stitch pattern can be formed within the predetermined available area or gives an error signal to the liquid crystal display 10 when the desired stitch pattern cannot be formed within the predetermined available area. A stitching scale can be selected by operating a scale key 42. A middle scale mode in which the desired stitch pattern is stitched on a middle scale is selected (FIG. 7(*b*)) when the scale key 42 in a state shown in FIG. 7(*a*) is depressed, and a small scale mode in which the desired stitch pattern is stitched on a small scale is selected (FIG. 7(*c*)) when the scale key 42 in a state shown in FIG. 7(*b*) is depressed. The CPU 23 gives an error signal to the liquid crystal display 10 to inhibit the selection of the scale if the desired stitch pattern cannot be formed on the selected scale in the available area.

For example, when selecting a stitch pattern "AB" as shown in FIG. 8, touch keys 46 and 47 respectively corresponding to the pattern elements "A" and "B" are depressed successively. The selected scale changes sequentially in order of "small"→"large"→"middle"→"small" every time the scale key 42 is depressed.

For example, suppose that a stitch pattern "ABCD" and the small scale mode have been selected, and it is desired to change the small scale mode for the middle scale mode. Then, the CPU 12 tries first to select the large scale mode. However, since the stitch pattern "ABCD" cannot be formed in the large scale within the predetermined available area, the CPU 12 sends an error signal to the liquid crystal display 10. Therefore, when the middle scale mode is desired, the operator must cancel the character "D," depress the scale key 42 twice to change the scale from "small" via "large" to "middle," and add the character "D" again to "ABC" to select the stitch pattern "ABCD," which is a troublesome and inefficient operation.

SUMMARY OF THE INVENTION

Accordingly, it is an object of the present invention to provide an embroidery machine having a stitch pattern selecting system capable of directly changing a selected scale for a desired scale to omit the repetition of a pattern element selecting operation for selecting a desired pattern element after selecting a desired scale so that a desired stitch pattern and a desired scale can be readily and efficiently selected by a simple stitch pattern selecting procedure.

To achieve this object, the present invention provides a stitch pattern selecting system for selecting a desired stitch pattern in an embroidery machine including: a stitching device for forming a stitch pattern in a predetermined available area, including a needle, a needle driving mechanism for vertically reciprocating the needle and a rotary hook assembly; an embroidery frame for detachably holding a workpiece; an embroidery frame moving device for moving the embroidery frame in directions along an X-axis and a Y-axis; an embroidery frame controller for controlling the embroidery frame moving device; a stitch pattern selecting device for selecting a stitch pattern having a predetermined area; and a scale changer for changing the scale on which to stitch the stitch pattern selected by the stitch pattern selecting device. The stitch pattern selecting device includes a calculating device for calculating the sizes of the selected stitch pattern on all the scales; a decision device for deciding if the calculated sizes of the selected stitch pattern are not greater than a predetermined available area; and a controller for specifying the available scales.

The stitch pattern selecting device selects a desired stitch pattern, the calculating device calculates the sizes of the selected stitch pattern on all the scales, the decision device decides if the calculated sizes are not greater than the predetermined available area, and the controller specifies the available scales. Accordingly, the components of the selected stitch pattern need not be recombined after determining a desired scale, so that a series of stitch pattern selecting operations can be efficiently and easily carried out.

BRIEF DESCRIPTION OF THE DRAWINGS

The above and other objects, features and advantages of the present invention will become more apparent from the following description taken in connection with the accompanying drawings, in which.

DETAILED DESCRIPTION OF PREFERRED EMBODIMENTS

An embroidery machine incorporating a stitch pattern selecting system embodying the present invention is substantially the same in mechanical configuration as known embroidery machines, and hence only a stitch pattern selecting procedure of the stitch pattern selecting system will be described with reference to FIGS. 4 to 12, and the description of the mechanical configuration of the embroidery machine will be omitted.

Figure 1:
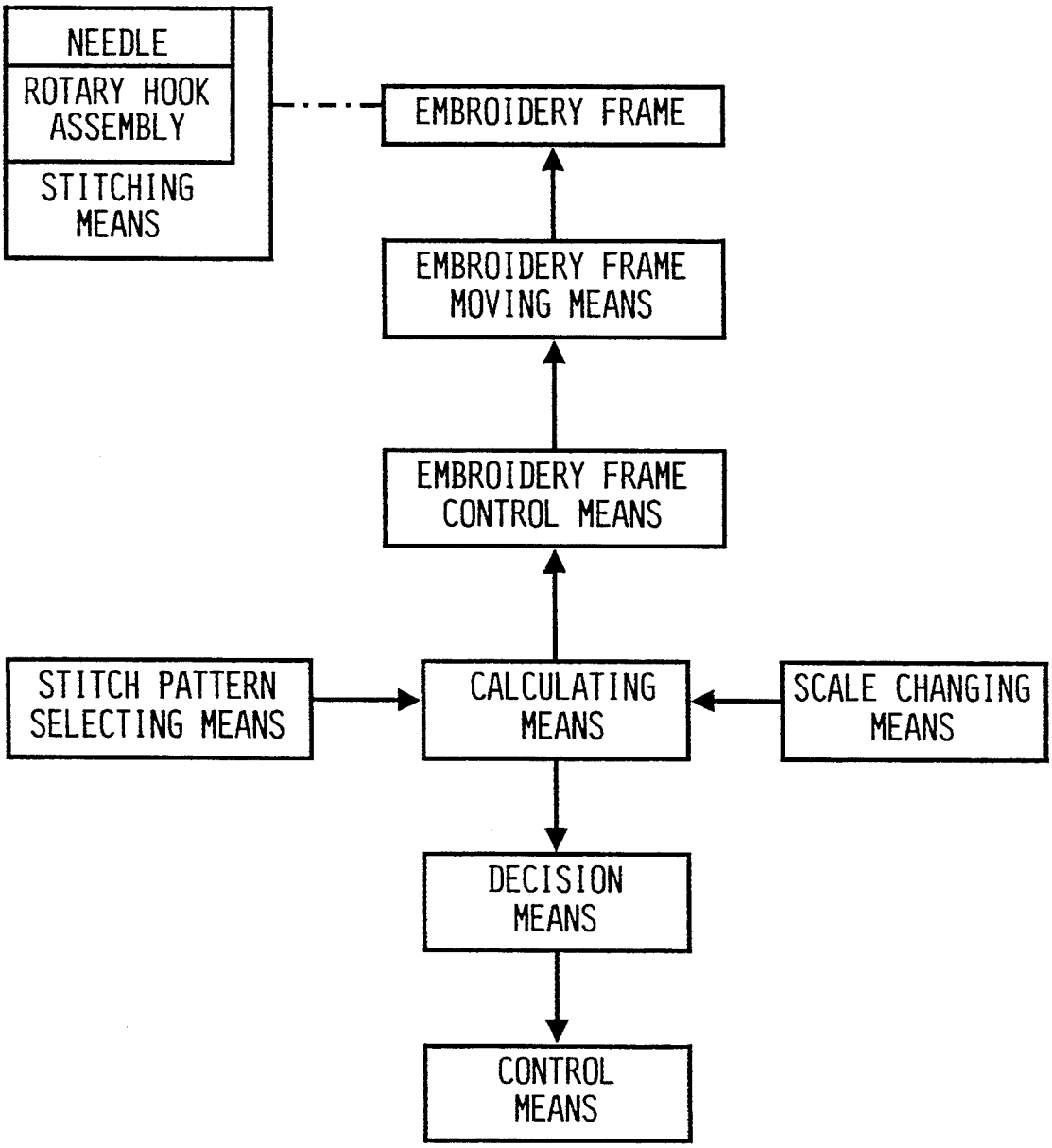
FIG. 1 is a block diagram of an embroidery machine incorporating a stitch pattern selecting system according to the present invention.
Figure 2:
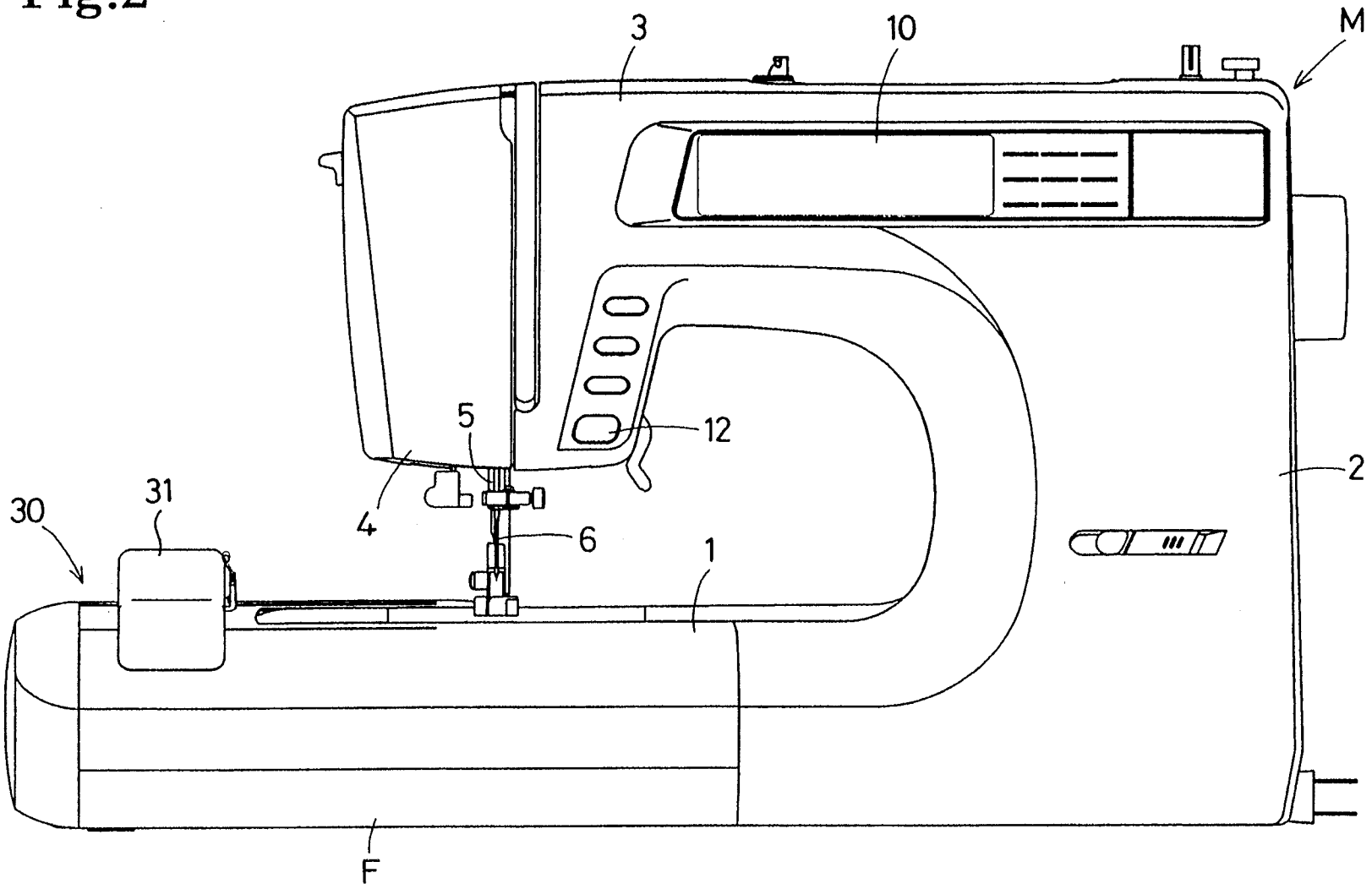
FIG. 2 is a front view of the embroidery machine of FIG. 1.
Figure 3:
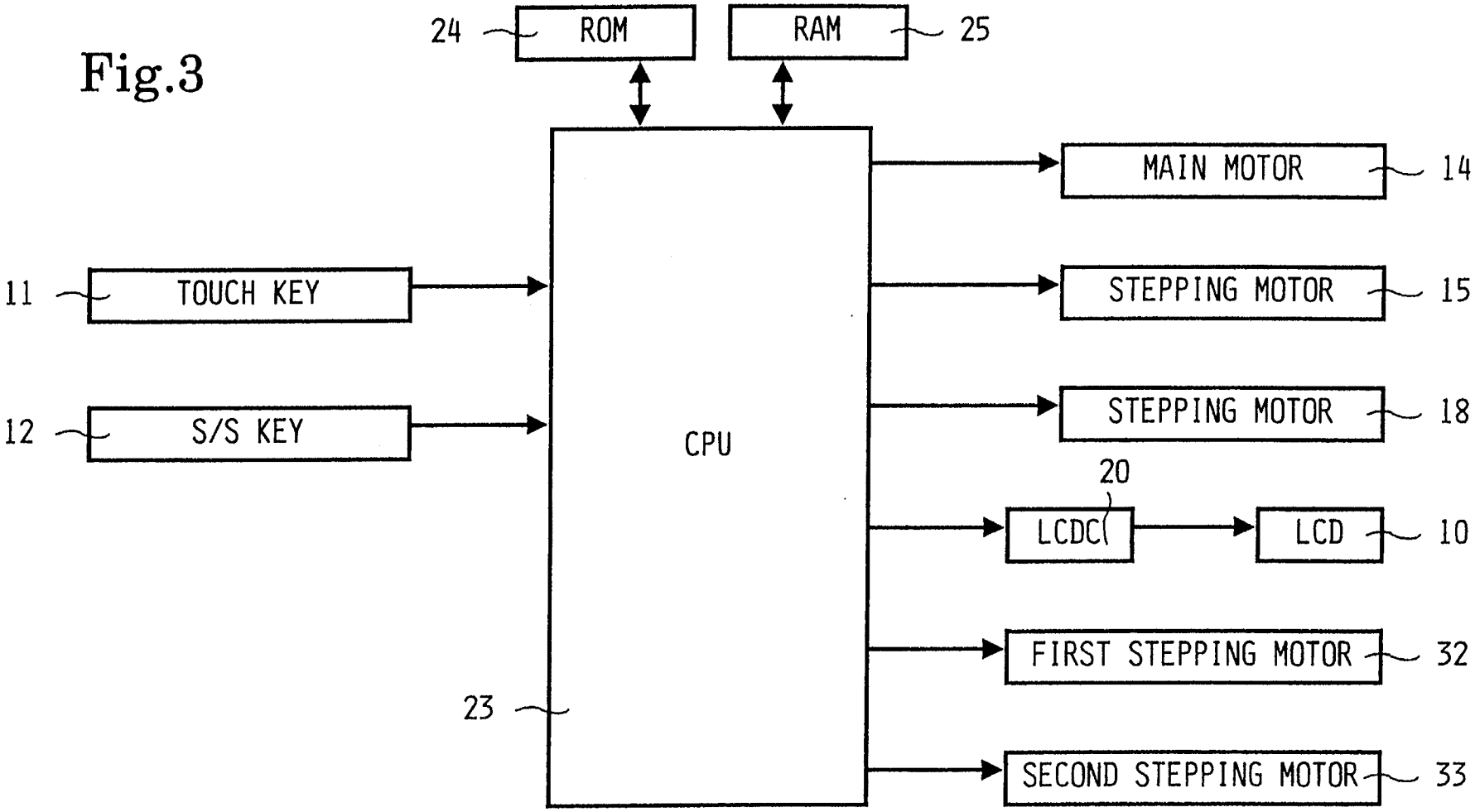
FIG. 3 is a block diagram of a control system for controlling the embroidery machine of FIG. 1.
Figure 4A:
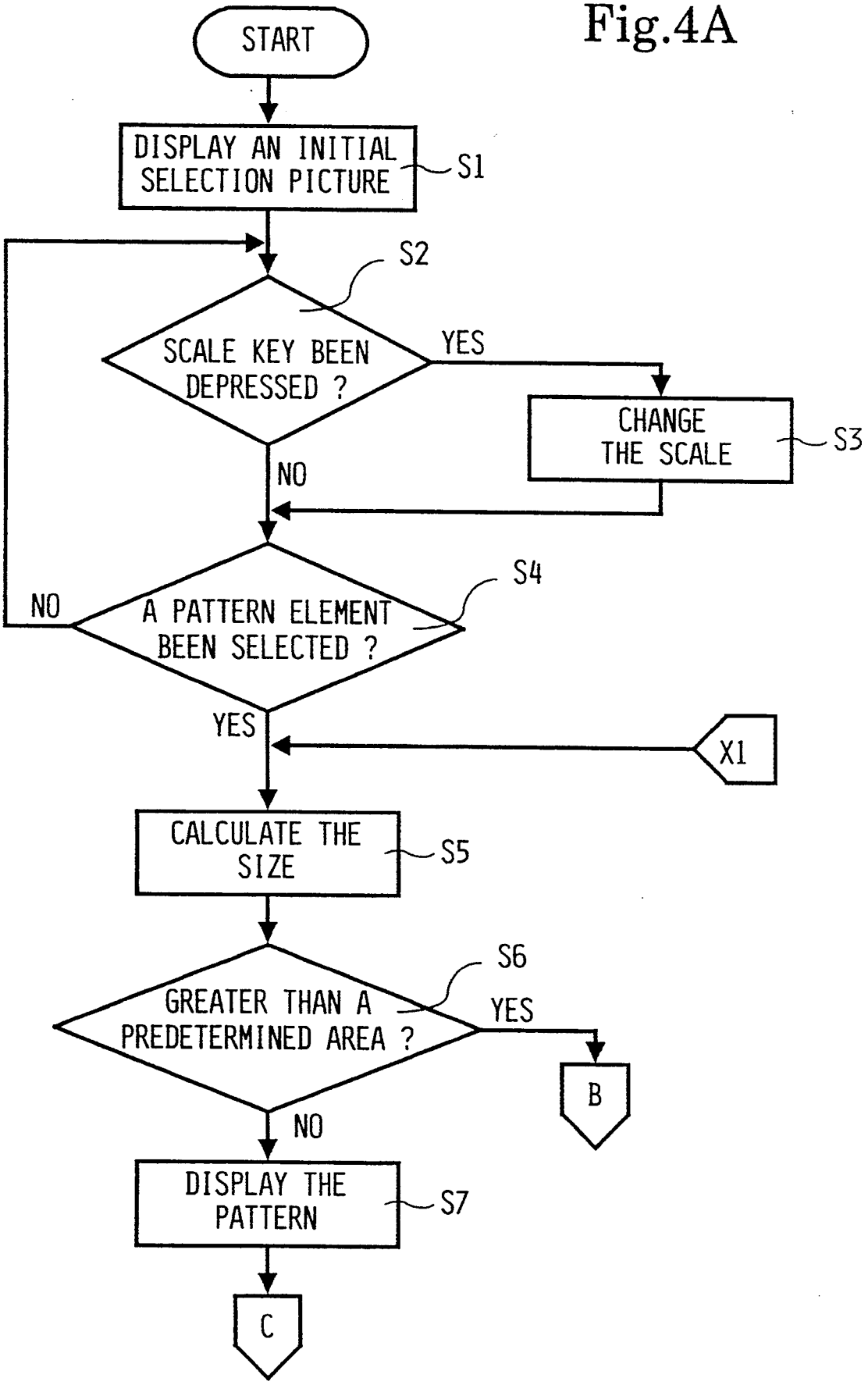
FIGS. 4A, 4B, 5A, 5B and 6 are flow charts of a control program to be executed by a stitch pattern selecting system incorporated into the embroidery machine of FIG. 1.
Figure 4B:
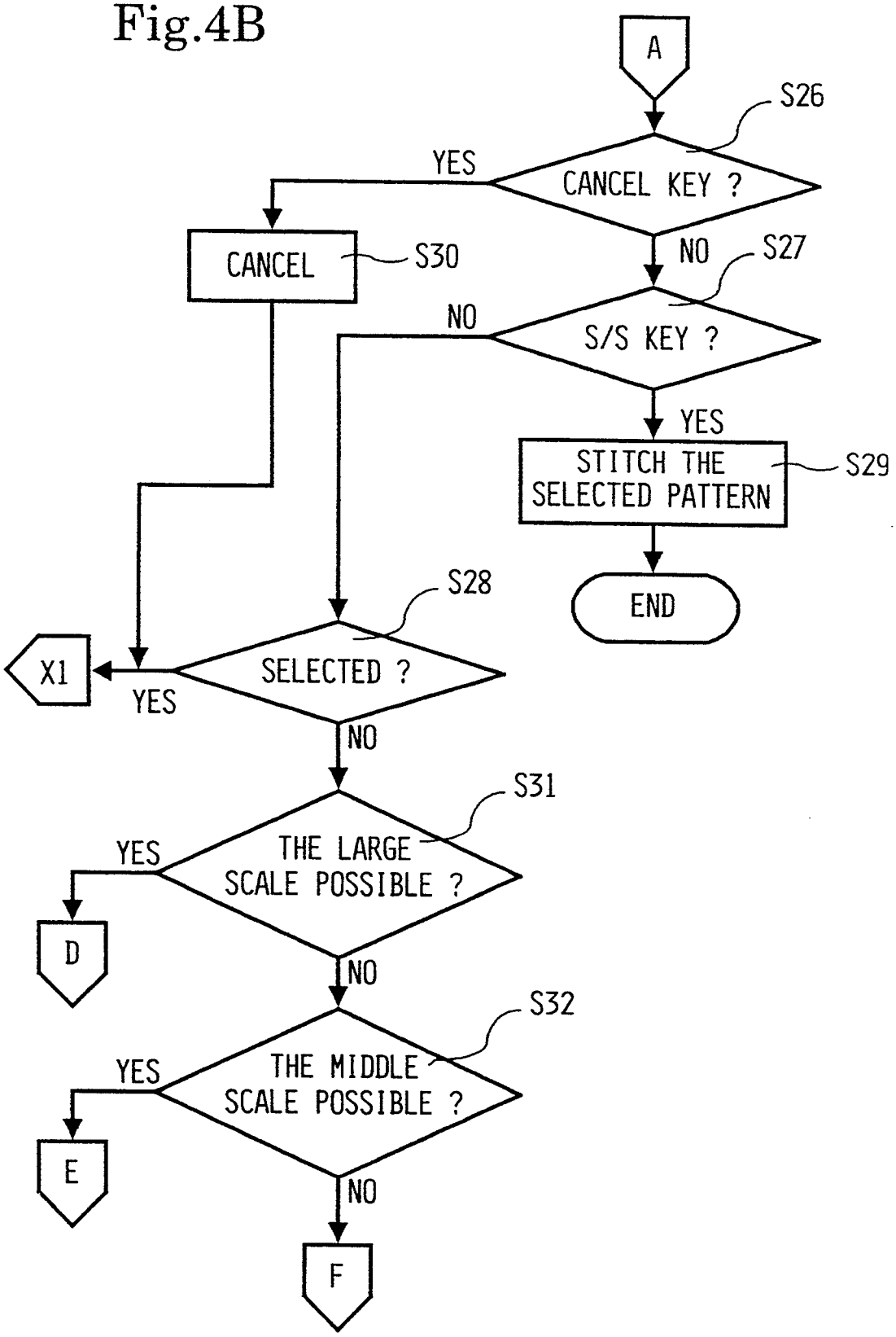
Figure 5A:
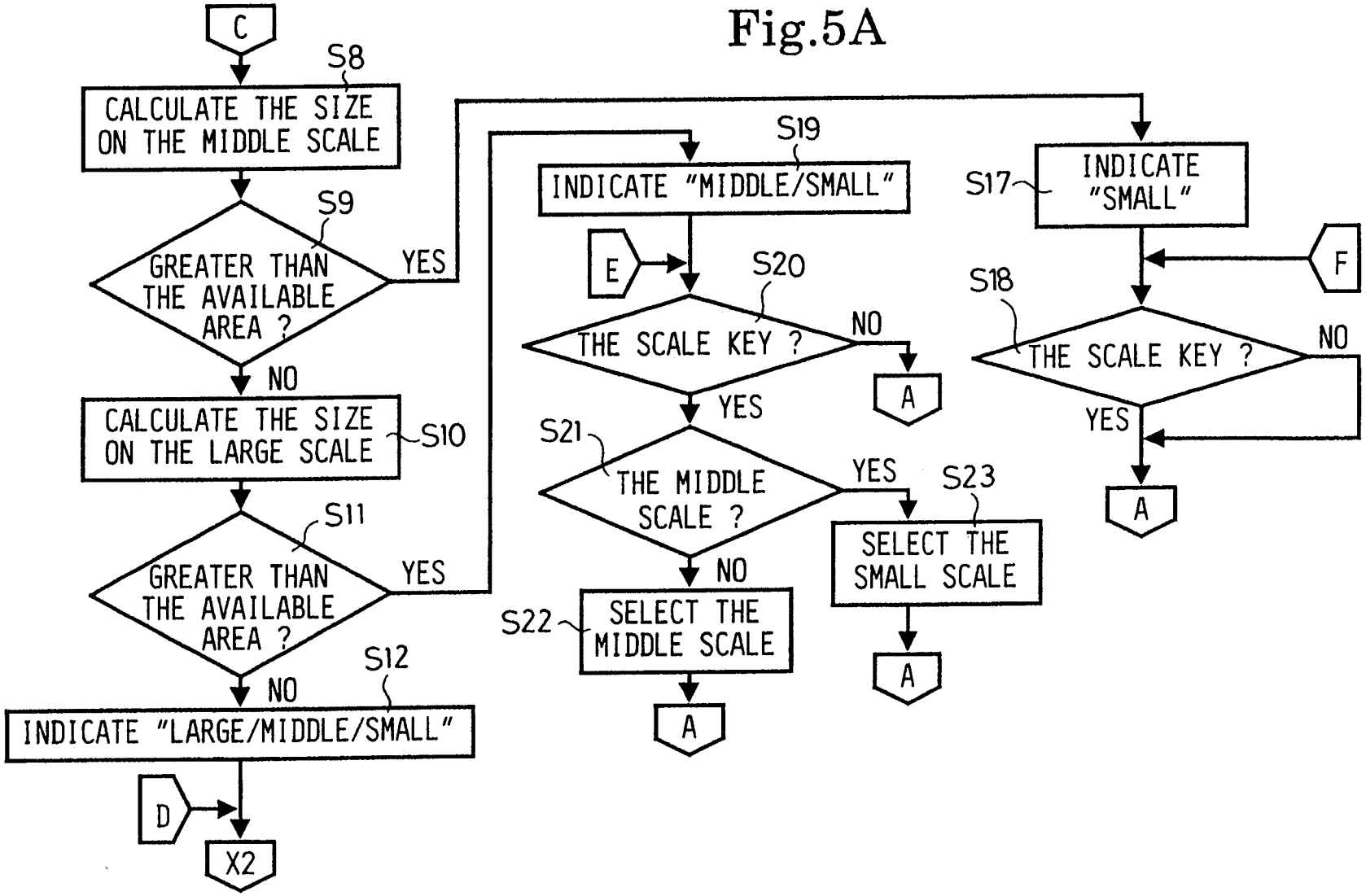
Figure 5B:
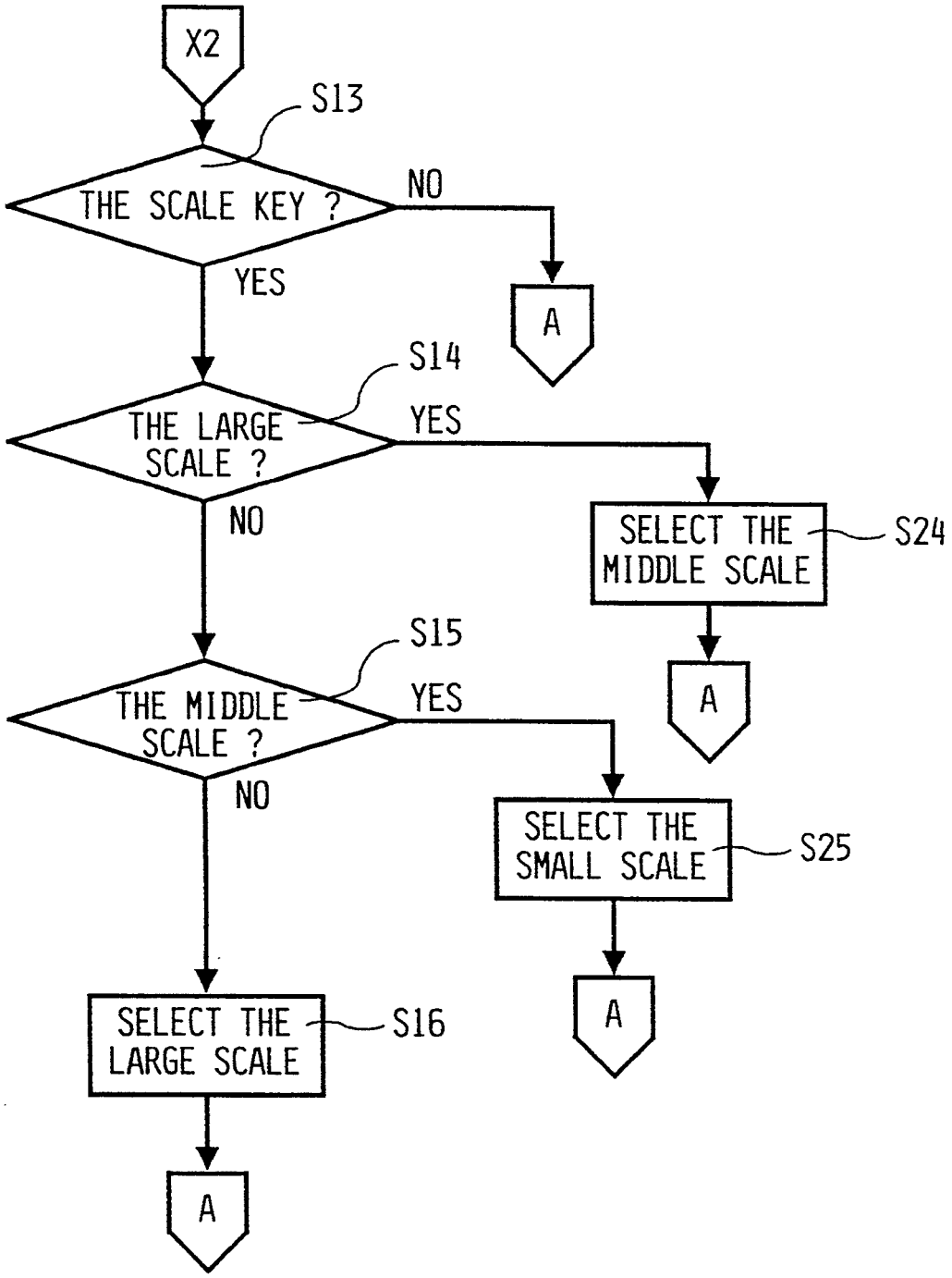
Figure 6:
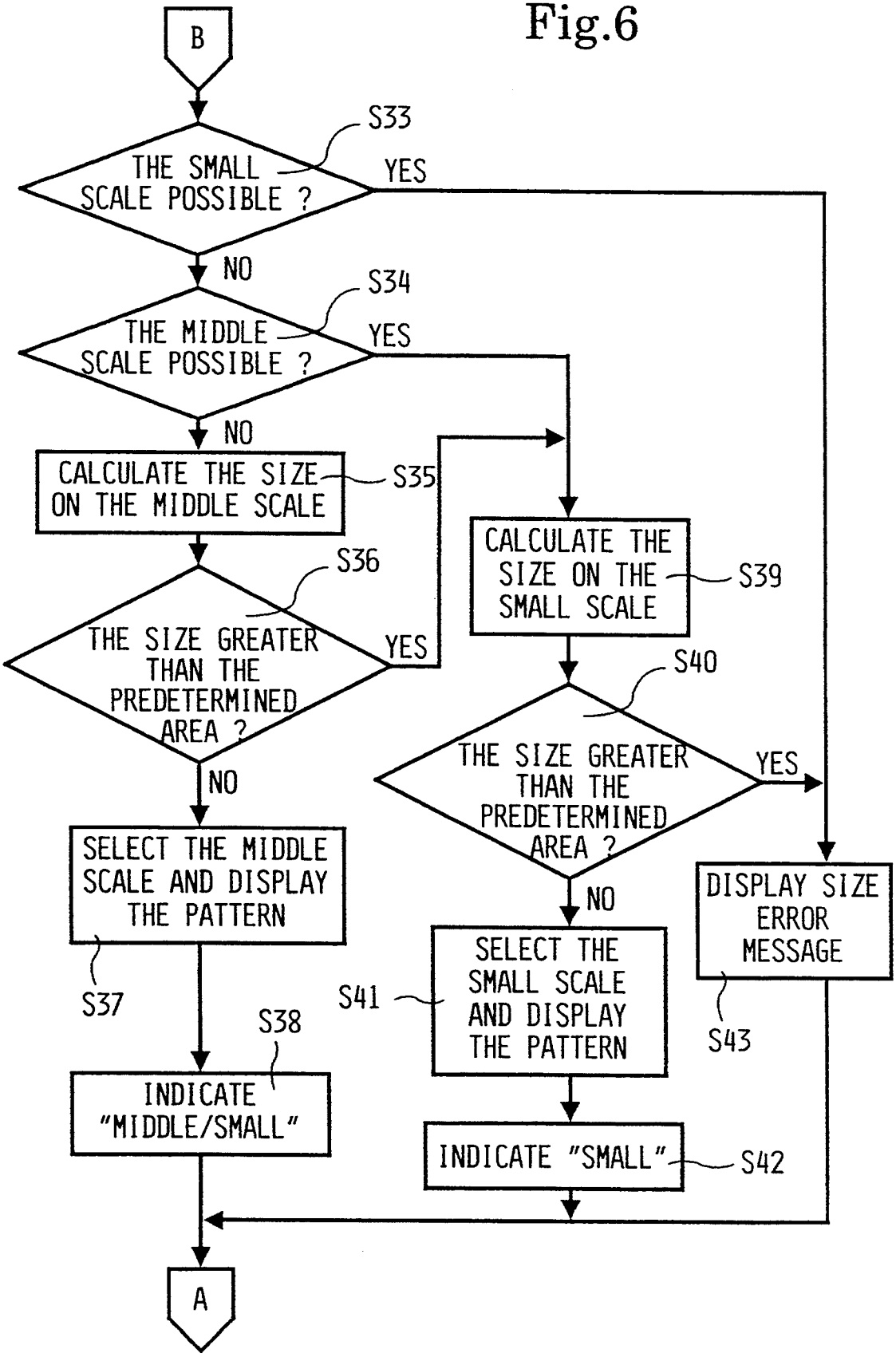
Figure 7:
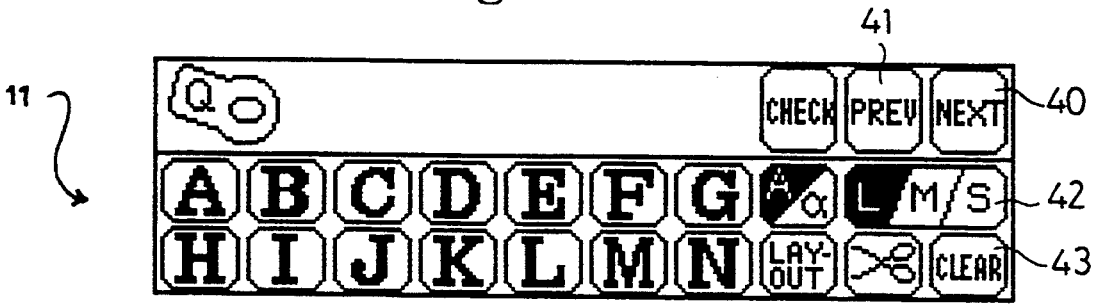
FIGS. 7(*a*)–(*c*), and 8 to 12 are pictorial views explaining a method of selecting a desired stitch pattern.
Figure 7:
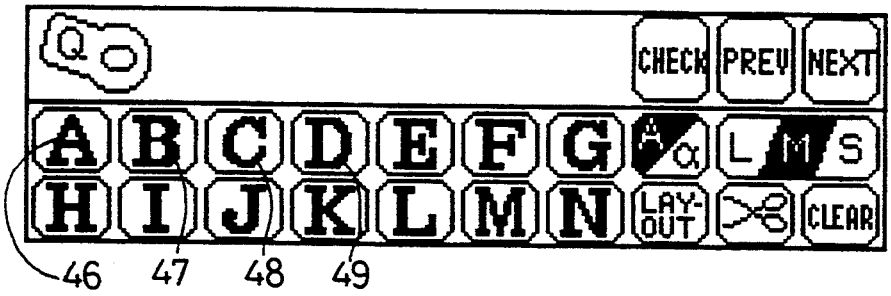
Figure 7:
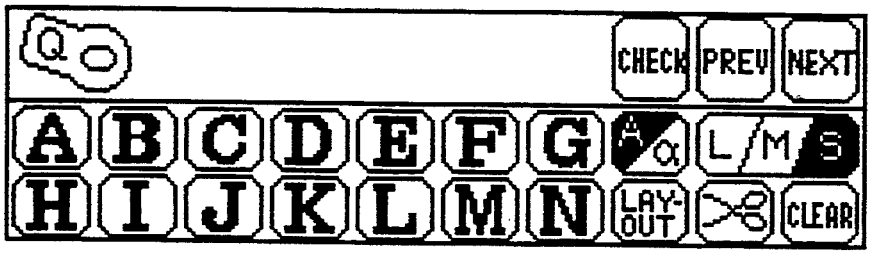
Figure 8:
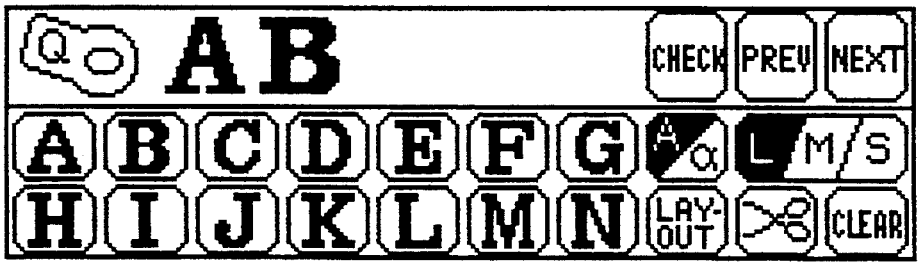

Upon the connection of an embroidery machine M to a power source, a CPU 23 reads a predetermined control program from a ROM 24 and carries out the control program. Referring to FIGS. 4A and 4B, an initial pattern element selection picture for a large scale pattern mode as shown in FIG. 7(*a*) is displayed in step S1. A query is made in step S2 to see if a scale key 46 is depressed. If the response in step S2 is affirmative, a second pattern element selection picture for a middle scale pattern mode as shown in FIG. 7(*b*) is displayed. If the response in step S2 is negative, the initial pattern element selection picture for the large scale pattern mode remains unchanged. If the response to a query in step S4 is negative, the control program returns to step S2. Then, if the scale key 42 is depressed, i.e., if the response to a query in step S2 is affirmative, a third pattern element selection picture for a small scale pattern mode as shown in FIG. 7(*c*) is displayed in step S3.

When a pattern element "A" is selected by depressing a touch key 46 corresponding to a symbol A, the response in step S4 is affirmative. The CPU 32 reads the size of the pattern element "A" on a small scale from the ROM 24 and makes a query in step S6 to see if the pattern element "A" on the small scale is greater than a predetermined available area. If the response in step S6 is negative, the pattern element "A" is displayed on a display 10 in step S7. Then, the size of the pattern element "A" on a middle scale is calculated in step S8, and a query is made in step S9 to see if the size of the pattern element "A" on the middle scale is greater than the predetermined available area. If the response in step S9 is negative, the size of the pattern element "A" on a large scale is calculated in step S10, and a query is made in step S11 to see if the size of the pattern element "A" on the large scale is greater than the predetermined available area. If the response in step S11 is negative, "Small/Middle/Large" is indicated on the scale key 42 in step S12.

In this state, the large scale for the large scale pattern mode is selected in step S16 when the scale key 42 indicating "Small/Middle/Large" as shown in FIG. 7(C) is depressed, the response in step S13 is affirmative, the response in step S14 is negative, and the response in step S15 is negative. If the scale key 42 as shown in FIG. 7(A) is depressed, the middle scale for the middle scale pattern mode is selected in step S24, in which the response in step S14 is affirmative. If the scale key 42 as shown in FIG. 7(B) is depressed, the small scale for the small pattern mode is selected in step S25, in which the response in step S14 is negative, and the response in step S15 is affirmative.

Figure 9:
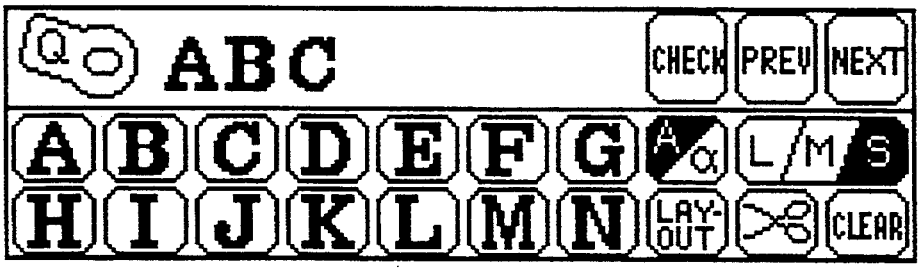
Figure 10:
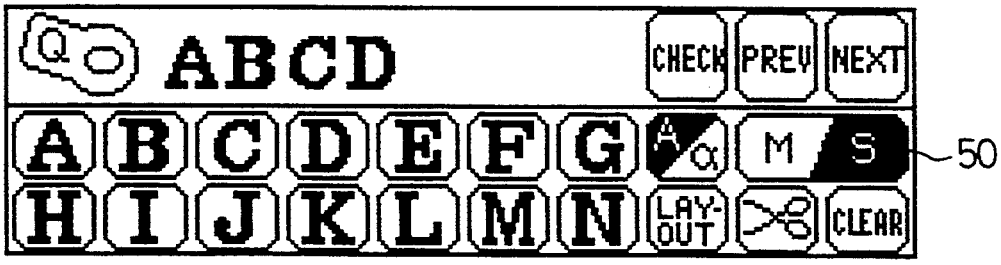

Then, the control program advances through exit and entry connector A to step S26 (FIG. 4B). If neither a cancel key 43 nor an S/S key 12 is depressed and no pattern element is selected, the responses in steps S26 and S27 are negative and the control program goes to step S31. Since the pattern element "A" can be formed on the large scale, i.e., the response in step S31 is affirmative, the control program goes to an exit connector D, and step S13 is executed to see if the scale key 42 indicating "Large/Middle/Small" is depressed. When the response in step S13 is negative, the control program goes through the exit and entry connector A to step S26. When the S/S key 12 is depressed, i.e., when the response in step S27 is affirmative, the pattern element "A" is stitched in step S29, and the control program is ended. When a second pattern element "B" on the small scale is selected, and a third pattern element "C" is selected after the selection of the second pattern element "B", the response in step S28 is affirmative, the foregoing steps for selecting the pattern element "A" are executed, and a pattern element selection picture shown in FIG. 9 is displayed.

When a fourth pattern element "D" is selected in addition to a pattern "ABC", and the size of a pattern "ABCD" on the large scale calculated in step S10 is greater than the predetermined available area, the response in step S11 is affirmative. Then, the indication "Large/Middle/Small" on the scale key 42 is changed to "Middle/Small" as indicated at 50 in FIG. 10. When the scale key 42 indicating "Middle/Small" is depressed, the response in step S20 is affirmative, and the small scale pattern mode changes to the middle scale pattern mode in step S22 (the response in step S21 is negative). If the current mode is the middle scale pattern mode, the middle scale pattern mode changes to the small scale pattern mode in step S23 (the response in step S21 is affirmative).

Then, the control program goes through the exit and entry connector A to step S26. If the responses in steps S26 and S27 are negative and no pattern element is selected (the response in step S28 is negative), the control program goes to step S31. When the pattern "ABCD" cannot be formed in a size on the large scale and can be formed in a size on the middle scale, i.e., the response in step S31 is negative, and the response in step S32 is affirmative, the control program returns to step S20, where a query is made to see if the scale key 42 indicating "Middle/Small" is depressed. When the response in step S20 is negative, the control program goes through the exit and entry connector A to step S26. When the cancel key 43 is depressed, the pattern element "D" is canceled in step S30, and the sizes of the pattern "ABC" on all the scales are calculated in step S5. If the pattern "ABC" can be formed in a size on the large scale, the pattern element selection picture of FIG. 9 is displayed.

If a fifth pattern element "F" is selected with the small scale selected, i.e., when the response in step S28 is affirmative, the same steps as those executed when the first pattern element "A" is selected are executed.

Figure 11:
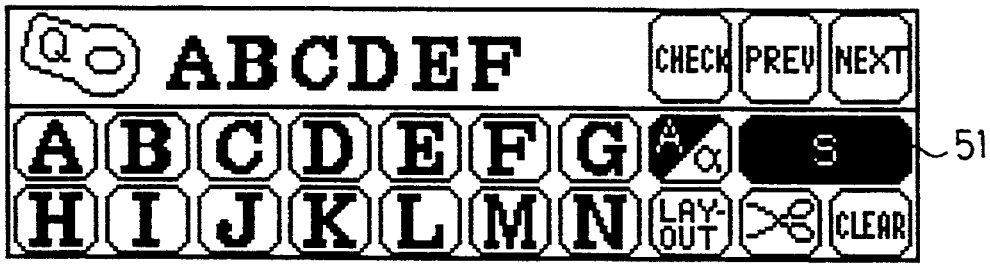

When a sixth pattern element "F" is selected, the size of a pattern "ABCDEF" on the middle scale is calculated in step S8, and a query is made in step S9 to see if the size of the pattern "ABCDEF" on the middle scale is greater than the predetermined available area, i.e., when the response in step S9 is affirmative, and the pattern "ABCDEF" on the small scale can be formed in the predetermined available area, an indication "Small" as indicated at 51 is indicated on the scale key 42 as shown in FIG. 11. The size is not changed whether the key 42 indicating "Small" is depressed, i.e., the response in step S18 is affirmative, or whether the same is not depressed, i.e., the response in step S18 is negative. Then, the control program goes through the exit and entry connector A to step S26. When the responses in steps S26 and S27 are negative and no further pattern element is selected (the response in step S28 is negative), the control program goes through steps S31 and S32 and entry connector F to step S18, because the pattern "ABCDEF" cannot be formed on the large scale or the middle scale.

Figure 12:
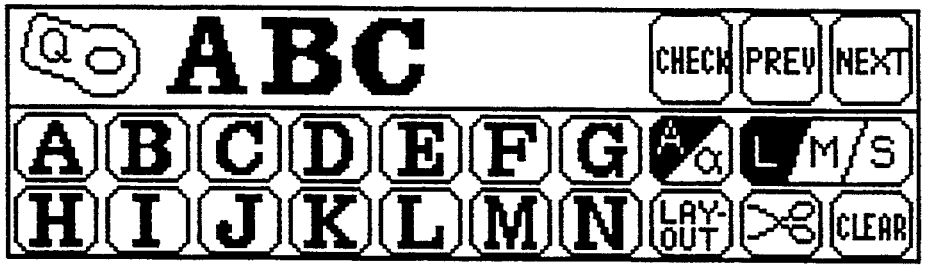

When the fourth pattern element "D" is selected by repeating the foregoing steps after selecting the pattern "ABC" on the large scale as shown in FIG. 12, the size of the pattern "ABCD" on the large scale is calculated in step S5, and a query is made in step S6 to see if the size of the pattern "ABCD" on the large scale is greater than the predetermined available area. If the response in step S6 is affirmative, a query is made in step S33 to see if it is true that "Small" is indicated on the scale key 42 and the small scale is selectable. If the response in step S33 is negative, a query is made in step S34 to see if it is true that "Middle/Small" is indicated on the scale key 42 and the middle scale is selectable. If the response in step S34 is negative, the size of the pattern "ABCD" on the middle scale is calculated in step S35, and a query is made in step S36 to see if the pattern "ABCD" on the middle scale is not greater than the predetermined available area. When the response in step S36 is negative, the middle scale is selected and the pattern "ABCD" of a size on the middle scale is displayed in step S37, and "Middle/Small" is indicated on the scale key 42 in step S38. When the response in step S36 is affirmative, i.e., when the size of the pattern "ABCD" on the middle scale is greater than the predetermined available area, the size of the pattern "ABCD" on the small scale is calculated in step S39, and a query is made in step S40 to see if the size of the pattern "ABCD" on the small scale is greater than the predetermined available area. When the response in step S40 is negative, the small scale is selected, and the pattern "ABCD" of a size on the small scale is displayed in step S41, and "Small" is indicated on the scale key 42.

If the pattern "ABCD" of a size on the small scale is greater than the predetermined available area, i.e., if the response in step S40 is affirmative, a size error message is displayed on the display 10 in step S43, and the control program goes through the exit and entry connector A to step S26. When the sixth pattern element "F" is selected after a pattern "ABCDE" and the middle scale have been selected to select a pattern "ABCDEF," and when the size of the pattern "ABCDEF" on the middle scale is greater than the predetermined available area, i.e., the response in step S6 is affirmative, the control program goes through exit and entry connector B to step S33. Since the middle scale is available in this state, i.e., the response in step S33 is negative, and the response in step S34 is affirmative, the size of the pattern "ABCDEF" on the small scale is calculated in step S39, and a query is made in step S40 to see if the size of the pattern "ABCDEF" on the small scale is greater than the predetermined available area. When the response in step S40 is negative, the small scale is selected, the pattern "ABCDEF" on the small scale is displayed on the display 10 in step S41, and "Small" is indicated on the scale key 42 in step S42. If the size of the pattern "ABCDEF" on the small scale is greater than the predetermined available area, a size error message is displayed on the display 10 in step S43, and the control program goes through the exit and entry connector A to step S26.

When a pattern element "H" is selected after a pattern "ABCDEFG" and the small scale have been selected, and when the size of the pattern "ABCDEFGH" on the small scale is greater than the predetermined available area, i.e., the response in step S6 is affirmative, the control program goes through the exit and entry connector B to step S33. However, since the size of the pattern "ABCDEFGH" on the small scale is greater than the predetermined available area and "small" is indicated on the scale key 42, a size error message is displayed on the display 10 in step S43, and the control program goes through the exit and entry connector A to step S26.

The embroidery machine in this embodiment uses three scales, namely, the large scale, the middle scale and the small scale, however, the embroidery machine may use any suitable number of scales.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A stitch pattern selecting and forming system for selecting and forming a desired stitch pattern in an embroidery machine, the stitch pattern selecting and forming system comprising:

stitching means for forming a stitch pattern in a predetermined available area on a workpiece, including a needle, a needle driving mechanism for vertically reciprocating the needle and a rotary hook assembly;

an embroidery frame for detachably holding a workpiece;

embroidery frame moving means for moving the embroidery frame in directions along an X-axis and a Y-axis;

embroidery frame control means for controlling the embroidery frame moving means;

stitch pattern selecting means for selecting a stitch pattern having a predetermined area; and scale changing means for selectively changing the scale of the stitch pattern selected by the stitch pattern selecting means in accordance with said predetermined available area, said scale changing means comprising determining means for determining which of a plurality of scales are available in accordance with said predetermined available area and said predetermined area of said stitch pattern in said plurality of scales.

2. The stitch pattern selecting system as claimed in claim 1, wherein said determining means comprises:

calculating means for calculating sizes of the selected stitch pattern in said plurality of scales;

decision means for deciding if the calculated sizes of the selected stitch pattern are greater than said predetermined available area; and control means for specifying which of said plurality of scales are available in accordance with the decision from the decision means.

3. The stitch pattern selecting system as claimed in claim 2, wherein said plurality of scales comprise a large scale, a middle scale, and a small scale.

4. The stitch pattern selecting system as claimed in claim 3, further comprising means for selecting one of said available scales for stitching by said stitching means.

5. The stitch pattern selecting system as claimed in claim 2, wherein said control means comprises means for providing a size error signal if none of said plurality of scales are available.

6. The stitch pattern selecting system as claimed in claim 2, wherein said control means comprises a liquid crystal display on said embroidery machine.

7. The stitch pattern selecting system as claimed in claim 1, wherein said stitch pattern selecting means comprises touch keys representative of stitch patterns on said embroidery machine.

8. A stitch pattern selecting and forming method for selecting and forming a desired stitch pattern in an embroidery machine including stitching means for forming a stitch pattern in a predetermined available area of a workpiece, including a needle, a needle driving mechanism for vertically reciprocating the needle and a rotary hook assembly, an embroidery frame for detachably holding a workpiece, embroidery frame moving means for moving the embroidery frame in directions along an X-axis and a Y-axis, and embroidery frame control means for controlling the embroidery frame moving means, the stitch pattern selecting and forming method comprising the steps of:

selecting a stitch pattern having a predetermined area;

determining which of a plurality of scales are available in accordance with said predetermined available area and said predetermined area of said stitch pattern in said plurality of scales;

specifying which of said plurality of scales are available in accordance with the determination in said determining step;

enabling a selection of one of the available scales; and forming a stitch pattern in said workpiece in accordance with the selected stitch pattern and the selected scale.

9. The stitch pattern selecting method as claimed in claim 8, wherein said determining step comprises the steps of:

calculating sizes of the selected stitch pattern on a plurality of scales; and determining if the calculated sizes of the selected stitch pattern are greater than said predetermined available area.

10. The stitch pattern selecting method as claimed in claim 9, wherein said plurality of scales comprise a large scale, a middle scale, and a small scale.

11. The stitch pattern selecting method as claimed in claim 9, further comprising the step of providing a size error signal if none of said plurality of scales are available.

12. The stitch pattern selecting method as claimed in claim 9, wherein said embroidery machine comprises a liquid crystal display.

13. A stitch pattern selecting system for selecting and forming a desired stitch pattern in an embroidery machine, the stitch pattern selecting and forming system comprising:

a needle, a needle driving mechanism for vertically reciprocating the needle, and a rotary hook assembly cooperating with said needle and said needle driving mechanism to form a stitch pattern in a predetermined available area;

an embroidery frame for detachably holding a workpiece;

a motor for moving the embroidery frame in directions along an X-axis and a Y-axis;

an embroidery frame controller for controlling the motor;

a stitch pattern selector for selecting a stitch pattern having a predetermined area; and a scale changer for changing the scale of the stitch pattern selected by the stitch pattern selector in accordance with said predetermined available area, said scale changer comprising a data processor for determining which of a plurality of scales are available in accordance with said predetermined available area and said predetermined area of said stitch pattern in said plurality of scales.

14. The stitch pattern selecting system as claimed in claim 13, wherein said data processor comprises:

a calculator for calculating sizes of the selected stitch pattern in said plurality of scales;

a deciding mechanism for deciding if the calculated sizes of the selected stitch pattern are greater than said predetermined available area; and a control device for specifying which of said plurality of scales are available in accordance with the decision from the deciding mechanism.

* * * * *